US005439399A

United States Patent [19]

Spechts et al.

[11] Patent Number: 5,439,399

[45] Date of Patent: Aug. 8, 1995

[54] POWER SUPPLY BLADE LOCK MECHANISM

[75] Inventors: Lee Spechts, Billerica; Tuvia Leneman, Newton, both of Mass.; Larry Pignolet, Woonsocket, R.I.

[73] Assignee: EMC Corporation, Hopkinton, Mass.

[21] Appl. No.: 190,265

[22] Filed: Feb. 2, 1994

[51] Int. Cl.[6] ..... H01R 4/42

[52] U.S. Cl. ..... 439/807

[58] Field of Search ..... 439/807, 863

[56] References Cited

U.S. PATENT DOCUMENTS

| | | | |
|---|---|---|---|
| 2,086,090 | 7/1937 | Ohlson | 439/807 |
| 2,193,691 | 3/1940 | Johnson et al. | 439/807 |
| 5,090,924 | 2/1992 | Pfaller et al. | 439/807 |

FOREIGN PATENT DOCUMENTS

| | | | |
|---|---|---|---|
| 769256 | 10/1967 | Canada | 439/807 |
| 764675 | 5/1934 | France | 439/807 |
| 1038086 | 9/1953 | France | 439/807 |
| 699501 | 11/1940 | Germany | 439/807 |

*Primary Examiner*—Gary F. Paumen

*Attorney, Agent, or Firm*—Daniel J. Bourque; Michael J. Bujold; Anthony G. M. Davis

[57] ABSTRACT

An interconnect device for a power supply blade having two flat sides comprising a first portion having a flat surface for contact with one flat side of the blade, and a second portion having a flat surface facing the first flat surface for contact with the other flat side of the blade. One flat surface is translatable toward and away from the other flat surface to engage and disengage the blade, respectively.

11 Claims, 2 Drawing Sheets

POWER SUPPLY BLADE LOCK MECHANISM

FIELD OF THE INVENTION

This invention relates to interconnection systems and more particularly, to a connector for a power supply assembly.

BACKGROUND OF INVENTION

Power supplies are used in all electronic equipment, including computer systems and data storage systems. For devices requiring substantial power, robust conductors leading to and from the power supplies are required. Since the electronic equipment requires a very steady, regulated source of power, it is critical that the electrical contact between the power supply input and output conductors and the device wiring or buss which carries the power be absolutely sound; even extremely brief intermittent connection episodes can cause severe problems to the electronic equipment fed from the power supply.

The power supplies for these larger pieces of electronic equipment are also relatively large and heavy. Of course it is necessary for personnel to have access to the power supplies and to be able to remove and replace them if necessary. Accordingly, the power supplies are typically arranged to be slid in and out of cabinets. If wires or cables are used to run power to and from the power supplies, they can easily get tangled during a sliding operation. Accordingly, operation is facilitated by using buss bars to which the power supplies connect. The use of buss bars requires the use of an electrical interconnect device connected to the buss bar, and a mating electrical interconnect device for the power supply, in which the two interconnect devices slidingly engage and disengage.

One such prior art power supply interconnect device which has been used with power supplies having blade-shaped conductors is shown in FIG. 1. Interconnect device 10 is bolted to buss bar 13 with bolt 15. Device 10 is arranged to engage and disengage with power supply electrical supply blade 14 of power supply 12 with contact arms 18 and 20 which are urged together by spring 28. Ends 24 and 26 of arms 18 and 20, respectively, are flared to provide a relatively wide opening so that the blade 14 does not have to be perfectly aligned with arms 18 and 20 in order to make good contact.

Interconnect device 10, however, has not proven to be a totally acceptable solution to the problem of providing electrical interconnection to a power supply blade having two flat sides. The primary problem is that the quality of the electrical contact between blade 14 and device 10 is dependent on spring 28. If power supply 12 or device 10 is subject to any vibration, blade 14 can bounce in contacts 18 and 20 and cause brief periods of intermittent contact, which can be fatal to the electronics dependent on a constant source of power from the power supply.

SUMMARY OF THE INVENTION

It is therefore an object of this invention to provide an interconnect device for a power supply blade which is not prone to intermittent electrical contact problems.

It is a further object of this invention to provide such an interconnect device which mechanically clamps down on the power supply blade in an easily releasable fashion.

It is a further object of this invention to provide such an interconnect device which can be utilized with electronic equipment using buss bars for carrying power to and from the power supplies.

This invention results from the realization that a positive-locking interconnect for a power supply blade may be accomplished with a metal interconnect device which includes two arms with a slot therebetween for accepting the blade and having flat surfaces facing both sides of the blade, in which one arm is translatable toward and away from the other arm to engage and disengage the power supply blade, respectively.

This invention features an interconnect device for a power supply blade. Typically, the blade has two flat sides. The interconnect device in a first embodiment includes a first portion having a flat surface for contact with a first flat side of the blade, and a second portion having a flat surface facing the flat surface of the first portion for contact with a second flat side of the blade. The interconnect device of this embodiment includes some means for translating one flat surface toward and away from the other flat surface to engage and disengage the blade, respectively. One surface, or both, may be moveable in this fashion.

Preferably, at least one portion includes first and second mating parts having mating inclined surfaces. In that case, the means for translating a flat surface toward and away from the other flat surface may include means for relatively translating the first and second mating parts toward and away from each other to cause the parts to slide along their mating inclined surfaces. This may be accomplished with a threaded member passing through the first part and engaged in the second part. One part may include a passage with a diameter substantially greater than that of the threaded member for loosely receiving the threaded member to allow it to move laterally in the passage. The threaded member may be engaged in the moving part by including in the moving part a transverse member having a threaded hole for receiving the threaded member. The transverse member may be received in a receiving passage which intercepts the passage for the threaded member. The transverse member receiving passage may be slightly wider than the transverse member to allow the transverse member to move within the passage. In one embodiment, the transverse member is cylindrical and the receiving passage has a round cross section.

Preferably, the portions of the interconnect device are interconnected at one end. This may be accomplished by use of a bifurcated block in which the portions are the arms of the block. In that case, the distal ends of the arms may be beveled to facilitate engagement with the power supply blade. There is preferably further included a means for mounting the portions to an electrical buss bar.

In a more specific embodiment, this invention may be accomplished with an interconnect device for a power supply blade having two flat sides, comprising a bifurcated block with a blade-receiving opening between two arms having flat surfaces exposed to the opening. One arm includes two mating parts meeting at mating inclined surfaces, wherein the distal part of the arm is translatable relative to the inner part. There is a lengthwise opening through both the distal and inner parts of the one arm, and a transverse passage through the distal part intersecting the lengthwise opening through the part. A transverse receiving member is in that transverse passage and includes a threaded hole for alignment with the lengthwise opening through the distal part. There is a threaded member passing loosely through the lengthwise opening and threadably engaged with the threaded hole to allow the distal part to be moved relative to the inner part for changing the width of the blade-receiving opening to engage and disengage with the power supply blade.

In another embodiment, this invention features an interconnect device for a power supply cantilever comprising a first portion for contact with one side of the cantilever and a second portion for contact with another side of the cantilever. Further included is some means for translating one portion toward and away from the other portion to engage and disengage the cantilever, respectively. The portions may be cantilevered arms fixed together at one end. The distal ends of the arms may be beveled to facilitate engagement with the power supply cantilever. One arm may include mating parts having mating inclined surfaces. In that case, the means for translating may include means for relatively translating the parts toward and away from each other to cause them to slide along their mating inclined surfaces.

BRIEF DESCRIPTION OF THE DRAWINGS

Other objects, features and advantages will occur to those skilled in the art from the following description of a preferred embodiment and the accompanying drawings in which.

DETAILED DESCRIPTION OF THE PREFERRED EMBODIMENT

Figure 1:
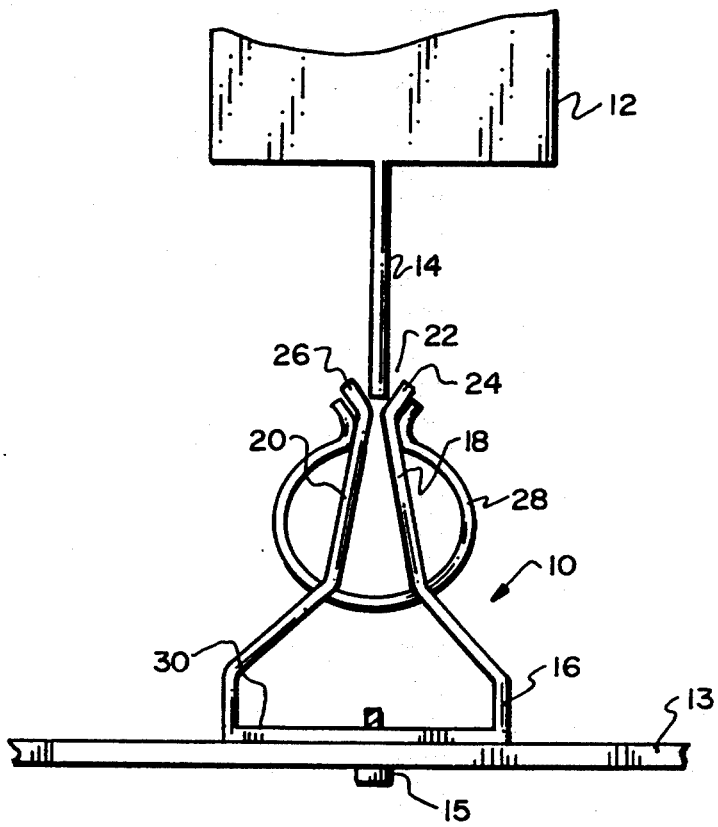
FIG. 1 PRIOR ART
FIG. 1 is a side view of a prior art power supply blade interconnect device.
Figure 2:
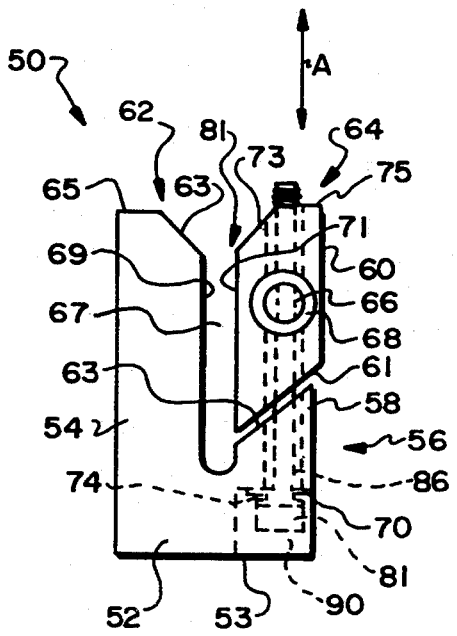
FIG. 2 is a side view of an embodiment of the power supply blade interconnect device according to this invention.

There is shown in FIGS. 2 through 7 interconnect device 50 according to this invention. Device 50 is preferably a bifurcated metal block having power supply blade-receiving opening 67 between cantilevered portions 54 and 56 interconnected at base 52, which is mounted to a buss bar such as buss bar 13, FIG. 1, as explained below. Portion 56 is divided into mating parts 58 and 60 which meet at inclined surfaces 63 and 61, respectively. Device 50 includes means for translating flat inner surface 71 of part 60 toward flat inner surface 69 of portion 54 to engage and disengage, respectively, a power supply blade inserted in slot 67. The translation is accomplished by moving part 60 toward and away from part 58 in the direction of arrow A using bolts such as bolt 70, **70*a* (not shown) threadably engaged in member 66**.

When part 60 is pulled toward part 58, surface 61 meets surface 63. As threaded member 70 is turned more, surface 71 moves toward surface 69 to decrease the width of slot 67. For this to happen, there must be sufficient play in oval openings 86 and **86*a* in part 58 through which members 70 and 70*a* pass to allow members 70 and 70*a* to themselves move toward and away from surface 69 along with part 60. This is accomplished by including oversized oval holes 86, 86*a* for accepting members 70, 70*a*, respectively, passing through part 58. Members 70 and 70*a* are then received within part 60 by including transverse cylindrical member 66 having threaded holes 84, 84*a*, FIG. 4. Member 66 fits in transverse opening 68 which intersects passageways 88, 88*a*, FIG. 5, through which bolts 70, 70*a*** pass.

Figure 7:
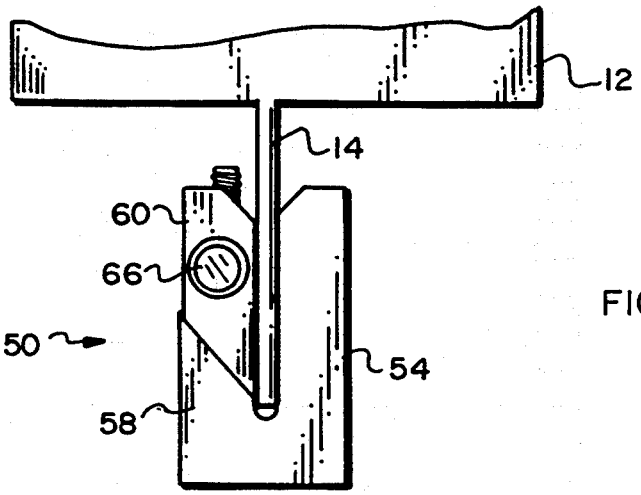
FIG. 7 is a view of the device of FIGS. 2 through 5 engaged with a power supply blade.

Preferably, openings 86, **86*a* are oval shaped to allow a relatively large amount of translational movement of the bolts toward and away from surface 69 as necessary to position part 60 tightly against blade 14 as shown in FIG. 7. Bolt 70 includes allen head 81, FIG. 2. Washer 74 is placed underneath head 81 to prevent the head from entering hole 86. Preferably, the bolt heads are recessed within block 52 by including oval recesses 90, 90*a* which allow the bottom of block 52 to be flat so that it can be tightly bolted onto a buss bar using bolts, not shown, passing through the bus bar and received in threaded holes 80 and 82 in the bottom 53 of block 52**.

Distal ends 62 and 64 of portions 54 and 56 are preferably beveled to create an enlarged opening 81 that helps to guide the power supply blade into slot 67. This bevel may be accomplished with 45° angled surfaces 63 and 73 and flat, outer surfaces 65 and 75 of portions 54 and 56, respectively. For a 0.130" thick power supply blade, the maximum and minimum working width of blade receiving slot 67 is preferably 0.072" and 0.170", respectively. This may be accomplished with 8–32 bolts 70, **70*a* and holes 86 and 86*a* which are 0.190×0.227 through-holes. Interconnect device 50 may be made entirely of nickel-plated copper with the exception of member 66**, which may be a zinc-plated steel rod.

Figure 3:
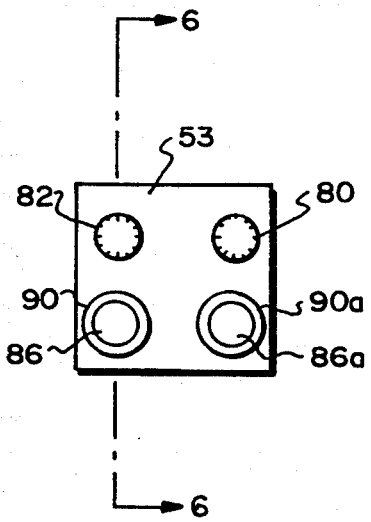
FIG. 3 is a bottom view of the device of FIG. 2.
Figure 4:
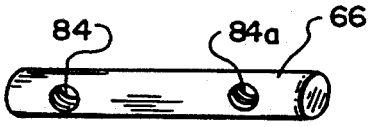
FIG. 4 is a three dimensional view of the transverse member of the device of FIG. 2 showing the receiving passage.
Figure 5:
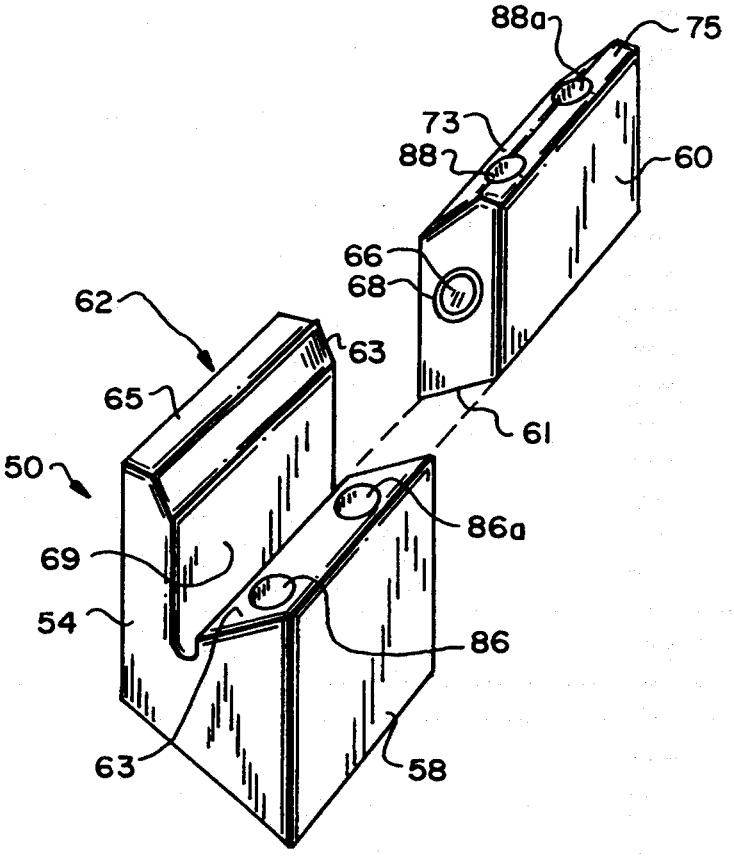
FIG. 5 is an exploded, three dimensional view of the device of FIG. 2.
Figure 6:
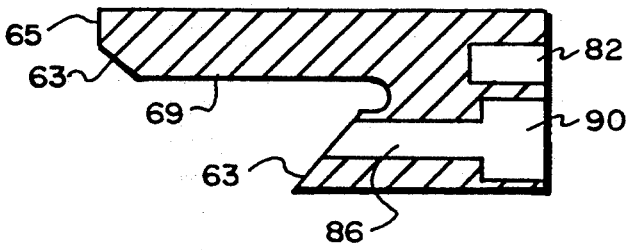
FIG. 6 is a cross-sectional view taken along line 6—6 of FIG. 3.

Thus, to use the interconnect device 50 of the present invention, the interconnect device is first secured to buss bar 13, FIG. 1, using screws 15 which are threaded into threaded holes 80, 82, FIG. 3. the buss bar preferably includes openings or slots (not shown) which correspond generally to holes 86, **86*a*, in the interconnect device 50, to allow the device to be secured to and released from the power supply blade 14**.

Once the power supply blade has been inserted into opening 67 of the interconnect device, fastening means such as first and second bolts 70 and **70*a* are inserted into opening 86, 86*a* from the blade 14. Bolts 70, 70*a* are threaded into and engaged with member 66 and subsequently tightened. The generally slotted or elongated size of the openings 86, 86*a*, as well as the bevel of surfaces 61, 63 cooperate to cause part 60 to move or translate toward the power supply blade 14**.

Bolts 70, **70*a* inserted into the steel member 66 allow the power supply blade contacting surfaces 61, 63 of the interconnect device of the present invention to be tightly and securely drawn together and held in tight contact, free from the effects of vibration and free from fear that the bolts may become loose or dislodged due to the softer nature of the copper interconnect device 50. Since hard steel member 66 has a large surface area in contact with the softer copper member 60, there is little to no danger of the interconnection becoming loose. Additionally, the large surfaces 61, 63 ensure a good electrical contact between the interconnect device 50** and the power supply blade. Although specific features of this invention are shown in some drawings and not others, this is for convenience only as some feature may be combined with any or all of the other features in accordance with the invention.

Other embodiments will occur to those skilled in the art and are within the following claims:

What is claimed is:

1. An interconnect device for a power supply blade having two flat sides, comprising:

a first portion having a flat surface for contact with a first flat side of the blade;

a second portion having a flat surface facing the flat surface of the first portion for contact with a second flat side of the blade;

at least one of said first and second portions including first and second mating parts having mating inclined surfaces; and means for translating a flat surface of at least one of said first and second portions toward and away from the flat surface of the other of said first and second portions to engage and disengage the blade, respectively, said means for translating including a threaded member passing through said first mating part and engaged with a threaded hole in a transverse member disposed in a transverse member receiving passage in said second mating part for relatively translating said first and second mating parts towards and away from each other to cause the mating parts to slide along their mating inclined surfaces.

2. The power supply blade interconnect device of claim 1 wherein said first mating part includes a passage with a diameter substantially greater than that of said threaded member for loosely receiving said threaded member to allow said threaded member to move laterally in said passage.

3. The power supply blade interconnect device of claim 1 in which said transverse member receiving passage is slightly wider than said transverse member to allow said transverse member to move within said receiving passage.

4. The power supply blade interconnect device of claim 1 in which said transverse member is cylindrical and said receiving passage has a round cross section.

5. The power supply blade interconnect device of claim 1 in which the first and second portions are interconnected at one end.

6. The power supply blade interconnect device of claim 5 in which the first and second portions are two arms of a bifurcated block.

7. The power supply blade interconnect device of claim 6 in which the distal ends of the arms are beveled to facilitate engagement with the power supply blade.

8. The power supply blade interconnect device of claim 1 further including means for mounting the portions to an electrical buss.

9. An interconnect device for a power supply blade having two flat sides, comprising:

a bifurcated block including two arms with a blade receiving opening between the two arms, each of said two arms having flat surfaces exposed to the blade receiving opening;

one arm of said two arms including two mating parts including a distal part and an inner part meeting at mating inclined surfaces, wherein the distal part is translatable relative to the inner part;

a lengthwise opening through both the distal and inner parts of the one said arm;

a transverse passage through said distal part and intersecting the lengthwise opening therethrough;

a transverse receiving member in said transverse passage and including a threaded hole for alignment with the lengthwise opening through said distal part; and a threaded member passing loosely through said lengthwise opening and threadably engaged with said threaded hole to allow the distal part to be moved relative to the inner part for changing the width of the blade receiving opening to allow engagement and disengagement with the power supply blade.

10. The power supply interconnect device of claim 9 in which the two arms are cantilevered arms fixed together at one end of each of said two arms.

11. The power supply interconnect device of claim 9 in which distal ends of said two arms are beveled to facilitate engagement with the power supply blade.

* * * * *